US005148865A

United States Patent [19]

Reed

[11] Patent Number: 5,148,865

[45] Date of Patent: Sep. 22, 1992

[54] MULTI-CONVERSION WELLHEAD ASSEMBLY

[76] Inventor: Lehman T. Reed, 3219 Candlewood Dr., Bakersfield, Calif. 93306-1617

[21] Appl. No.: 681,978

[22] Filed: Apr. 8, 1991

[51] Int. Cl.[5] ..... E21B 33/03

[52] U.S. Cl. ..... 166/76; 166/77

[58] Field of Search ..... 166/77, 84, 88, 89, 166/75.1, 335, 352, 85, 76

[56] References Cited

U.S. PATENT DOCUMENTS

| | | | |
|---|---|---|---|
| 3,163,430 | 8/1962 | Normand | 166/84 |
| 4,299,395 | 11/1981 | Reed | 166/84 |
| 4,345,766 | 8/1982 | Turanyi | 166/84 |
| 4,541,490 | 9/1985 | Bigbie | 166/88 |
| 4,627,487 | 12/1986 | Reed | 166/88 |
| 4,645,214 | 2/1987 | Copley | 166/84 |
| 4,804,045 | 2/1989 | Reed | 166/76 |
| 5,000,719 | 3/1991 | Reed | 166/88 |

*Primary Examiner*—Ramon S. Britts
*Assistant Examiner*—Frank S. Tsay
*Attorney, Agent, or Firm*—John H. Crowe

[57] ABSTRACT

A wellhead assembly having a tubing hanger for supporting a tubing string and a diversionary block with a bonnet part, the tubing hanger and bonnet part having aligned holes for transmitting fluid through the tubing string or for receiving a pump rod. The tubing hanger and bonnet part have additional aligned holes, and the wellhead assembly includes sealing plugs, electrical cable connectors and other parts adapted to be interchangably mounted in the additional holes so that the wellhead can be reversibly converted to suit it for service in different injection and production modes of operation without having to rework the wellhead assembly or substitute another wellhead assembly for it.

13 Claims, 4 Drawing Sheets

FIG. 1
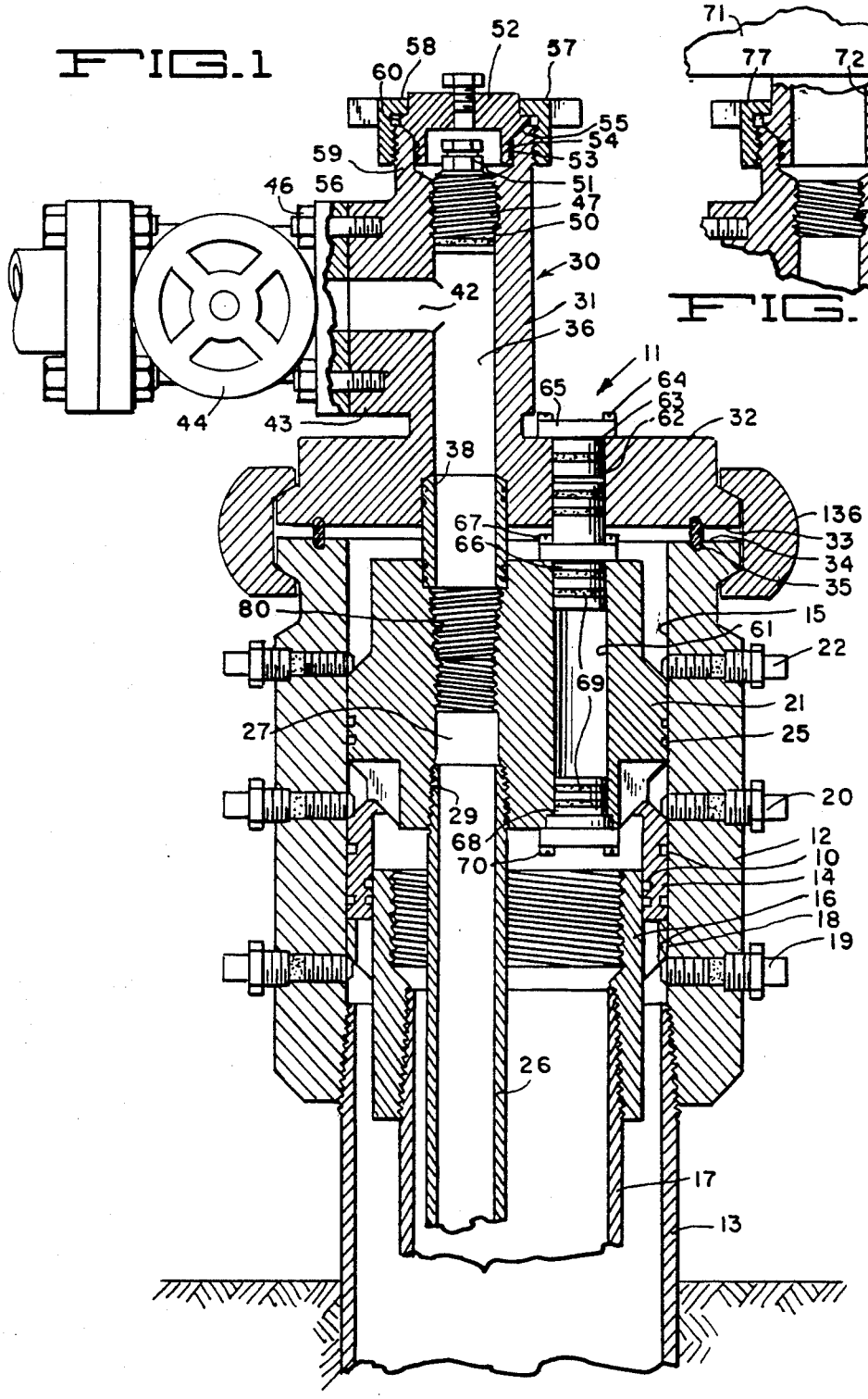
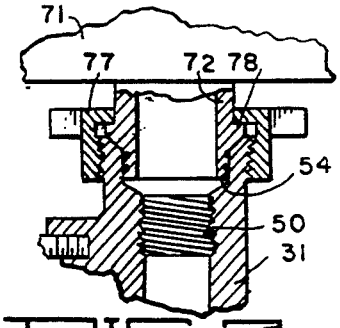
FIG. 2

52
57

47
31
42
36
80
64
175
44
62
32
136
176
67
15
61
21
27
12
177
70
14
16
26
81
17
13

MULTI-CONVERSION WELLHEAD ASSEMBLY

BACKGROUND OF THE INVENTION

1. Field of the Invention

This invention relates to wells and has particular reference to a wellhead assembly for oil and gas wells which is reversibly convertible for use in a variety of injection and production modes of operation.

2. Description of the Prior Art

In my U.S. Pat. No. 4,804,045, granted on Feb. 14, 1989, I disclosed and claimed a diversionary device for oil and gas wells designed to obviate the need for permanently mounting a conventional valve, or Christmas, tree arrangement on each injection or producing well. Such a valve tree is expensive and cumbersome, and the use of my diversionary device makes it possible to employ a single valve tree to service a number of wells. Thus, the valve tree need be temporarily mounted on a well only when maintenance or remedial work is to be performed thereon.

Such diversionary devices have met with considerable success and can be used on different wellhead assemblies adapted for different injection and production modes, which modes depend upon various factors such as well depth, oil viscosity, gas-oil ratios, etc. For example, certain wellheads are constructed or modified to permit free flow or artesian production. Others are constructed or modified to permit pumping by electrically operated submersible pumps. Others are constructed or modified for use with reciprocating rod pumps. Still others are constructed or modified for use in the injection of a fluid such as water or gas into a well to pressurize the underground oil or gas formation.

Over a period of time pumping conditions may change, thereby requiring replacement or modification of a wellhead assembly to adapt the same to a more appropriate injection or production mode for maintaining a desired degree of efficiency. This generally entails expensive reworking or replacement of the wellhead assembly, as well as a loss of expensive operating time while the well is out of operation.

SUMMARY OF THE INVENTION

I have now, by this invention, provided a single wellhead assembly designed for use with any of the conventional injection or production modes presently employed for the recovery of crude oil from underground deposits. I have accomplished this versatility of use by providing dual access means to a well casing, each capable of separate use under specific operating conditions. My novel wellhead assembly includes all of the necessary parts to convert the well from one production mode to another without having to replace the assembly or have it modified in some way in a machine shop. As will be seen, such conversion can be accomplished at the site through the use of simple hand tools and without any alteration or deformation of any of the parts of the assembly. I have thus, by means of my unique wellhead assembly design, provided a single installation that can be used for virtually any mode of oil production at a wellhead by simple techniques for converting its use capability from one production mode to another which can be easily performed at the site without damaging or destroying the adaptability of the assembly for conversion to any mode of operation. Heretofore this has not been possible, with the result that the changing of a wellhead assembly from one injection or production mode to another was time consuming, expensive and wasteful of equipment.

It is therefore a principal object of the present invention to provide a single wellhead assembly that is adapted for use in many different injection or production modes by the mere rearrangement of certain of its parts and without any mechanical reworking of the assembly.

Another object of the invention is to provide such a wellhead assembly which can be quickly, easily and reversibly modified to adapt it for different injection or production modes.

Another object is to provide means for reducing the time and expense involved in changing a wellhead assembly from one injection or production mode to another.

A further object of the invention is to provide a compact and low profile wellhead assembly by means of which a plurality of wellheads can be located in close proximity to each other whereby the safety of service men performing maintenance work on a well is enhanced.

Still another object of the invention is to provide a simple, versatile and relatively inexpensive wellhead assembly utilizing a diversionary device.

BRIEF DESCRIPTION OF THE DRAWINGS

The manner in which the above and other objects of the invention are accomplished will be readily understood from the following specification when read in conjunction with the accompanying drawings, wherein:

FIG. 1 is a vertical sectional view of a wellhead assembly embodying a preferred form of the present invention and showing the same adapted to operate in a free flowing or artesian mode or in a gas or water injection mode.

FIG. 2 is a fragmentary sectional view illustrating the attachment of a valve tree to the upper end of the wellhead assembly.

DESCRIPTION OF THE PREFERRED EMBODIMENT

Figure 3:
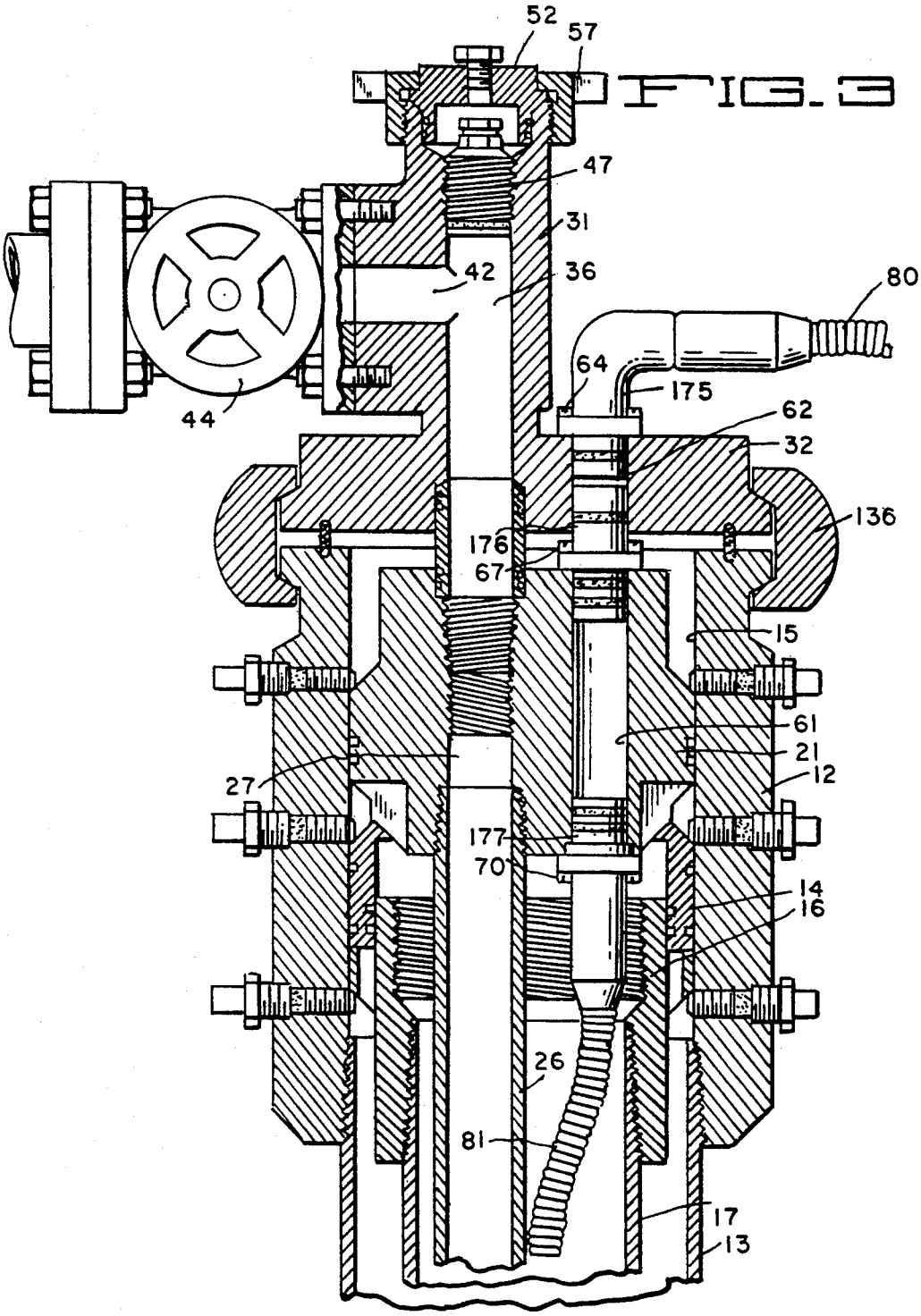
FIG. 3 is a sectional view similar to FIG. 1 but illustrating the wellhead assembly as adapted to operate with an electric submersion pump.

Referring first to FIG. 1, a wellhead assembly is generally indicated at 11 and comprises an annular wellhead 12, into the lower end of which is threaded a casing string 13 installed in a well in the usual manner. A tubular spacer ring 14 is slidably mounted in a vertical bore 15 in the wellhead and slidably receives a tubular casing hanger 16 which is threadedly connected to the upper end of an intermediate casing string 17. The spacer ring 14 at its lower end abuts an annular shoulder 18 on the hanger 16. The latter is located in place by lock screws 19 which are threaded through the wall of the wellhead 12 and the ring 14 is held in place at its upper end by lock screws 20 also threaded through the wall of the wellhead. Sealing rings 10 on the ring 14, prevent fluid leakage therepast.

A tubing hanger 21 is slidably mounted in the wellhead bore 15 and is held in place abutting the top of the ring 14 by lock screws 22. Sealing rings 25 seal the hanger within the bore 15. A tubing string 26 extending into the well is threadedly connected at 29 in a vertical bore 27 extending through the hanger 21. The bore 27 is offset laterally from the axis of the wellhead bore 15.

A diversionary assembly generally indicated at 30 is located above the wellhead 12 and comprises a one piece diversionary block 31 having a bottom flange 32 which forms a bonnet part for sealingly covering the wellhead bore 15. For this purpose, the bonnet part 32 has a flat bottom surface 33 which faces a similar top surface 34, on the wellhead, an annular sealing ring 35 being interposed therebetween.

An annular clamp 136 of conventional construction clamps the bonnet part 32 in sealing engagement with the wellhead 12.

A vertical passage 36 extends through the block 31 in alignment with bore 27 in hanger 21 and a tubular connector 38 is sealingly fitted into the upper end of bore 27 and the lower end of passage 36.

The diversionary block 31 has a horizontal passage 42 therein communicating with passage 36 and opening into a flange 43 at the side of the block. A flow control valve 44 is attached to flange 43 by bolts 46 to control the flow of fluid through the passages 36 and 42.

A sealing plug 47 is secured in a screw-threaded section 50 in the upper end of the passage 36 and has a head 51 at its top to permit removal of the plug by a suitable tool as will be described later.

The upper end of the passage 36 above plug 47 is enlarged to form a counterbore 54 and is normally sealed by a cap 52 having a depending annular projection or skirt 53 which slidably fits into the counterbore. A conical seat 55 on the cap 52 fits against a mating conical seat formed in an annular flange or cylindrical portion 59 of block 31. Sealing rings 56 seal the cap in the counterbore 54. The cap 52 is retained in place by a wing nut 57 threaded onto the upper end 59 of the block 31 and having an internal flange 58 which fits against an annular shoulder 60 on the cap.

Tubing hanger 21 has a second vertical auxiliary bore 61 extending therethrough in parallel offset relationship with bore 27. Bore 61 is aligned with a second auxiliary bore 62 extending through the bonnet part 32 of block 31. A sealing plug 63 is normally fitted into the upper end of bore 62 and removably secured to the bonnet part 32 by screws 64 which extend through a flange 65 on the plug and are threaded into the bonnet part 32. A second sealing plug 66 is normally fitted into the upper end of bore 61 and lower end of bore 62 and removably secured in position by screws 67. A third sealing plug 68 is normally fitted into the lower end of the bore 61 and is removably secured in place by screws 70. O-rings 69 seal the plugs 63, 66 and 68 in their respective bores.

From the foregoing, it will be seen that when the above-described parts are in the positions shown in FIG. 1, the well is in condition to be operated in a free flowing, artesian or hydraulic production mode wherein oil or gas can flow directly upwardly through the tubing 26 and into the diversionary block passage 36, then outwardly through control valve 44. Conversely, the well can be operated in a water-flooded or gas lift injection mode in which the fluid is injected through the valve 44 and downwardly into the well through tubing 26.

To perform maintenance or remedial work on the well, the cap 52 is removed by unscrewing the nut 57 and replacing the cap by a conventional (Christmas tree) valve arrangement, partly shown at 71 in FIG. 2. The valve array 71 has a depending skirt 72 similar to skirt 53 of cap 52. A wing nut 77, similar to nut 57, is fitted over an annular shoulder 78 around the base of the valve array. Thus, when the skirt 72 is inserted into the counterbore 54 and the nut 77 tightened, a suitable tool (not shown) may be applied through the valve arrangement 71 to the head 51 of sealing plug 47 to loosen and remove the plug and thereby permit direct access to the interior of the well through the tubing string 26.

If the tubing string 26 is to be removed from the well to permit work access thereto, the valve 44 is disconnected from the diversionary block 31 and the clamp 136 is released permitting removal of the block 31, during which time the block 31 will separate from the sealing connector 38 and the sealing plug 66. The lock screws 22 can then be retracted and the hanger 21 and tubing string 26 pulled upwardly by attaching a suitable hoisting device (not shown) to a threaded section 80 of the hanger bore 27. When the desired work on the well has been completed, the above procedure is reversed and the well returned to operation.

If it is desired to employ an electrically operable submerged pump (not shown) in the well, the diversionary block 31 and tubing hanger 21, along with tubing string 26, are removed in the manner noted above. The sealing plugs 63, 66 and 68 are removed and replaced by interconnected electrical conductor connecting devices or cartridges 175, 176 and 177 (FIG. 3) which are sealingly fitted and secured in the bores 61 and 62 by the screws 64, 67 and 70, respectively. Such cartridges can be similar to those disclosed in my aforementioned patent (U.S. Pat. No. 4,804,045).

An electric power supply cable 80 is connected to cartridge 175 and a second power supply cable 81 extends downwardly from the cartridge 177 to the submerged electric pump that can be supported in the well by the tubing string 26, now replaced in the well. When this conversion is completed and the well is operating, oil and/or gas flow will be conducted upwardly through the tubing string 26 and through diversionary block passages 36 and 42 and thence outwardly through control valve 44.

Figure 4:
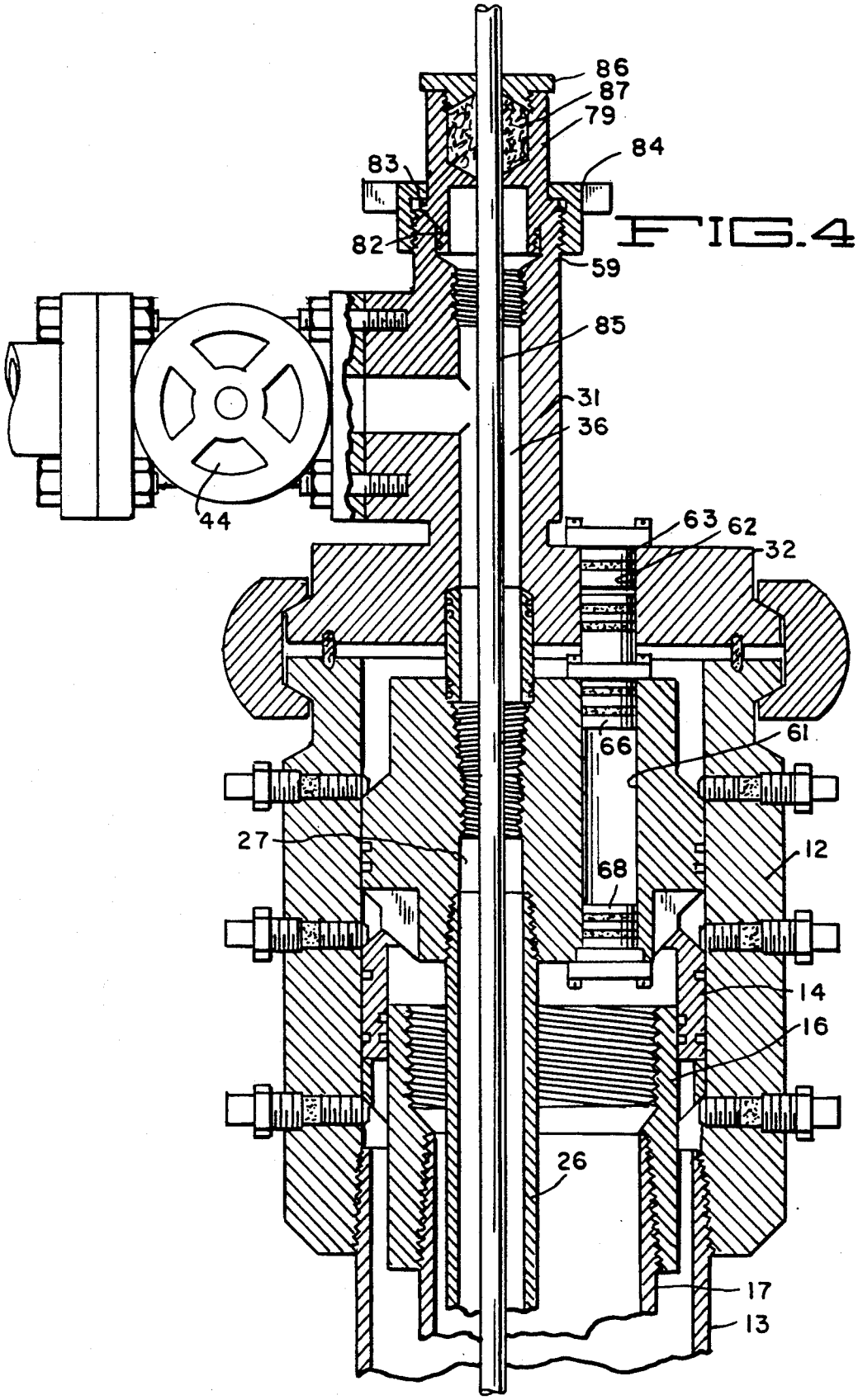
FIG. 4 is another sectional view similar to FIG. 1 but illustrating the wellhead assembly as adapted to operate with a reciprocating rod pump.

If it is desired to change the wellhead assembly to employ a reciprocating rod pump, the parts are disassembled in the manner noted above. The sealing plugs 63, 66 and 68 are replaced and secured in the bores 61 and 62. The cap 52 (FIGS. 1 and 3) is replaced by a tubular packing or gland member 79 (FIG. 4) having a depending annular skirt 82 and annular shoulder 83, similar to the skirt and shoulder formed on cap 52. A wing nut 84 similar to wing nut 57 is used to tighten the member 79 onto the upper cylindrical end 59 of the diversionary block 31.

A reciprocating rod 85 is extended downward through the packing gland member 79 and tubing 26 to a conventional reciprocating pump (not shown) located below the tubing string 26. A cap 86 is threadedly secured to the upper end of the gland member 79 to retain suitable sealing material 87 in sliding sealing engagement with rod 85. A suitable actuator (not shown) may be attached to the upper end of the rod 85 for reciprocating the same.

Figure 5:
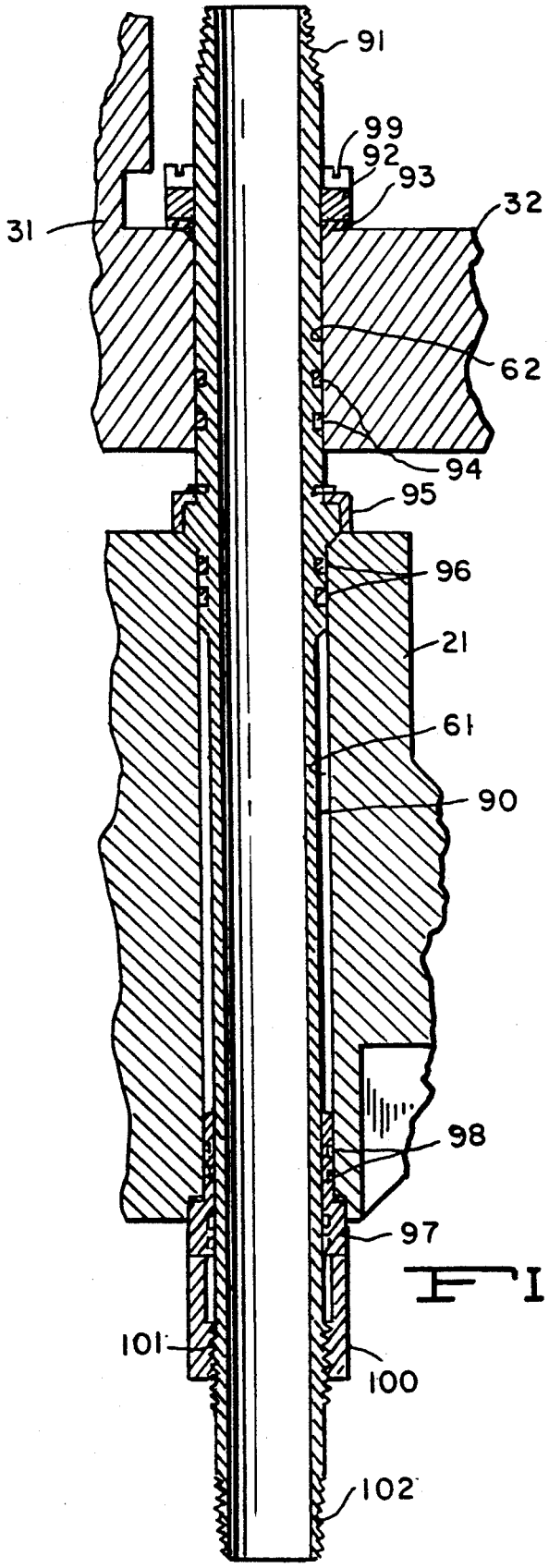
FIG. 5 is an enlarged sectional view through part of tubing hanger and bonnet parts shown in FIG. 1 and showing a hollow mandrel mounted in aligned auxiliary bores in the assembly to permit functioning thereof in certain modes of operation.

FIG. 5 shows an enlarged sectional view of part of the bonnet part 32 of block 31 and tubing hanger 21 with their aligned auxiliary bores 62 and 61, respectively, in which is removably mounted a hollow mandrel 90 in lieu of the sealing plugs 63, 66 and 68.

The mandrel 90 adapts the well to other modes of operation such as gas lift or water flood and permits suitable survey or monitoring tools to be inserted into the well.

The mandrel is threaded at 91 at its upper end for connection to appropriate surface equipment (not shown). A retainer 92 is slidably mounted on the mandrel and fastened in position to press against an elastomeric sealing ring 93 between it and bonnet part 32 by means of screws 99. O-rings 94, abetted by sealing ring 93, serve to seal the mandrel in the bore 62. A flange 95 is formed on the mandrel 91 to rest against the upper surface of tubing hanger 21 and O-rings 96 seal the mandrel in bore 61.

A sealing sleeve 97 is slidably mounted on the lower end of the mandrel 91 and O-rings 98 thereon seal the mandrel at its lower end in bore 61. A retainer nut 100 is screwed onto the mandrel at 101 to clamp the sleeve 97 in place. The lower end of the mandrel is threaded at 102 for connection to appropriate tubing (not shown) or to suitable surveying or monitoring equipment in the well.

It will be seen from the foregoing that I have provided a wellhead assembly which can be easily and readily changed to perform in different operating modes by merely changing or adding auxiliary parts which can be kept as stored items. The wellhead, with the aligned bores 61 and 62 formed therein, can be provided in kit form including the sealing plugs 63, 66 and 68 of FIG. 1; the electrical cartridges 175, 176 and 177 of FIG. 2; and the mandrel of FIG. 5, permitting the wellhead to be readily and quickly changed to adapt the same to any of the various aforementioned or other modes of operation. This is of paramount importance in areas or countries where reworking or manfacturing facilities are unavailable or difficult to find. Also, the delay and expense involved in changing the wellhead assembly to adapt it to different operating modes is held to a minimum.

I claim:

1. A wellhead assembly for oil and gas wells comprising an annular wellhead with a bore therethrough;

a tubing hanger mountable in said bore, said tubing hanger having first and second holes therethrough;

means for supporting a tubing string in the first hole;

means forming a bonnet with a first flow passage therein and a third hole therethrough;

means for mounting said bonnet over said wellhead with said first flow passage in alignment with said first hole and said third hole in alignment with said second hole; and sealing plug means removably mountable in the second and third holes;

whereby said wellhead assembly is usable with some production modes of operation when said sealing plug means are positioned for sealing off said second and third holes and with other production modes when said sealing plug means are not so positioned.

2. A wellhead assembly in accordance with claim 1 including fastening means adapted to permit its support of a Christmas tree valve array over a well when maintenance work is to be performed on said well and in which said means forming a bonnet comprises a diversionary block having a sealing plug removably and sealingly mountable in said first flow passage;

said diversionary block having a second flow passage communicating with said first flow passage intermediate said sealing plug and said tubing hanger; and said diversionary block having closure means interchangeably mountable with said Christmas tree valve array over said first flow passage whereby when said Christmas tree valve array is mounted over said first flow passage a suitable tool can be inserted into said first flow passage for removal of said sealing plug to enable maintenance work to be performed on said well.

3. A wellhead assembly in accordance with claim 2 including valve means for controlling fluid flow through said second flow passage.

4. A wellhead assembly in accordance with claim 2 including a hollow mandrel removably mountable in said second and third holes interchangeably with said sealing plug means to permit operation of the wellhead assembly in gas lift, single hydraulic and water flood modes.

5. A wellhead assembly in accordance with claim 2 including an electric cable assembly comprising electrical connecting devices removably mountable in said second and third holes interchangeably with said sealing plug means, whereby the wellhead assembly is operable in conjunction with a submerged electrically operating pump.

6. A wellhead assembly as defined in claim 4 wherein said hollow mandrel has annular flange means to support it in position in said second and third holes and which includes retainer nut means threadedly engageable with the lower portion of said mandrel to help removably secure said mandrel in said position.

7. A wellhead assembly as defined in claim 2 in which said fastening means is adapted to permit the mounting of said closure means interchangeably with said Christmas tree valve array on said diversionary block over said first passage, and comprises:

a depending cylindrical projection and an annular shoulder on said closure means;

an annular flange extending upwardly from said diversionary block to form a socket for slidably receiving said depending cylindrical projection; and a clamp nut threadedly mountable on said annular flange to overlie said annular shoulder whereby to removably clamp said depending cylindrical projection in said socket.

8. A wellhead assembly as defined in claim 7 having a conical seat on the upper end of said annular flange and a conical shoulder on said depending cylindrical projection below said annular shoulder engageable with said conical seat.

9. A wellhead assembly in accordance with claim 2 in which said closure means includes sliding seal means incorporated therein for slidably sealing a reciprocating pump rod for operation of said well therewith.

10. A wellhead assembly in accordance with claim 6 including an electric cable assembly comprising electrical connecting devices removably mountable in said second and third holes interchangeably with said sealing plug means to permit the operation of said well with a submerged electrically operating pump;

said wellhead assembly including fastening means adapted to permit the mounting of said closure means interchangeably with said Christmas tree valve array on said diversionary block over said first passage, said fastening means comprising:

a depending cylindrical projection and an annular shoulder on said closure means;

an annular flange extending upwardly from said diversionary block to form a socket for slidably receiving said depending cylindrical projection; and a clamp nut threadedly mountable on said annular flange to overlie said annular shoulder whereby to removably clamp said depending cylindrical projection in said socket.

11. A wellhead assembly in accordance with claim 10 having a conical seat on the upper end of said annular flange and a conical shoulder on said depending cylindrical projection below said annular shoulder engageable with said conical seat.

12. A wellhead assembly in accordance with claim 11 in which said closure means includes sliding seal means incorporated therein for slidably sealing a reciprocating pump rod for operation of said well therewith.

13. A wellhead assembly in accordance with claim 12 including valve means for controlling fluid flow through said second flow passage.

* * * * *